US006454958B1

(12) United States Patent
Loehr

(10) Patent No.: US 6,454,958 B1
(45) Date of Patent: Sep. 24, 2002

(54) METHOD AND DEVICE FOR OPERATING ETCHING BATHS

(75) Inventor: Karsten Loehr, Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/445,922

(22) PCT Filed: Mar. 11, 1998

(86) PCT No.: PCT/EP98/01388

§ 371 (c)(1),
(2), (4) Date: Dec. 13, 1999

(87) PCT Pub. No.: WO98/41672

PCT Pub. Date: Sep. 24, 1998

(30) Foreign Application Priority Data

Mar. 14, 1997 (DE) ..... 197 10 563

(51) Int. Cl.[7] ..... B44C 1/22

(52) U.S. Cl. ..... 216/93; 216/102; 134/10; 134/13; 210/644; 210/649; 210/650; 210/660; 210/673; 210/805

(58) Field of Search ..... 134/10, 13; 216/93, 216/102; 210/673, 660, 644, 649, 650, 652, 723, 805

(56) References Cited

U.S. PATENT DOCUMENTS 5,118,399 A 6/1992 Vaughan
5,141,610 A 8/1992 Vaughan
5,198,085 A * 3/1993 Vaughan ..... 204/182.4
5,403,490 A * 4/1995 Desai ..... 210/652
5,587,083 A 12/1996 Twardowski

FOREIGN PATENT DOCUMENTS

| | | |
|---|---|---|
| DE | 38 15 271 | 11/1989 |
| EP | 0 465 822 | 1/1992 |
| JP | 4-128392 | 4/1992 |
| JP | 5-212985 | 8/1993 |
| WO | 85/01670 | 4/1985 |
| WO | 95/27681 | 10/1995 |

* cited by examiner

*Primary Examiner*—Randy Gulakowski
*Assistant Examiner*—M. Kornakov
(74) *Attorney, Agent, or Firm*—Kenyon & Kenyon

(57) ABSTRACT

A method of operating a milling bath wherein a metal workpiece to be milled is immersed in a milling bath containing a milling medium, the metal oxidizing owing to a chemical reaction between the metal and milling medium and being transformed into a soluble complex. The resultant mixture is subjected to a separation process which separates the excess milling medium from the complex, the recovered milling medium being used for the further operation of milling baths and the complex being subjected to a preparation process. A mixture of dissolved complexed metallic ions and milling medium is removed from the milling bath at a concentration of dissolved complexed metallic ions which is far below the saturation limit thereof. The separation process is a nanofiltration process in which the milling medium is separated from the mixture according to the principle of reverse osmosis, the residue simultaneously being concentrated with complexed metallic ions.

9 Claims, 2 Drawing Sheets

METHOD AND DEVICE FOR OPERATING ETCHING BATHS

FIELD OF THE INVENTION

Figure 1:
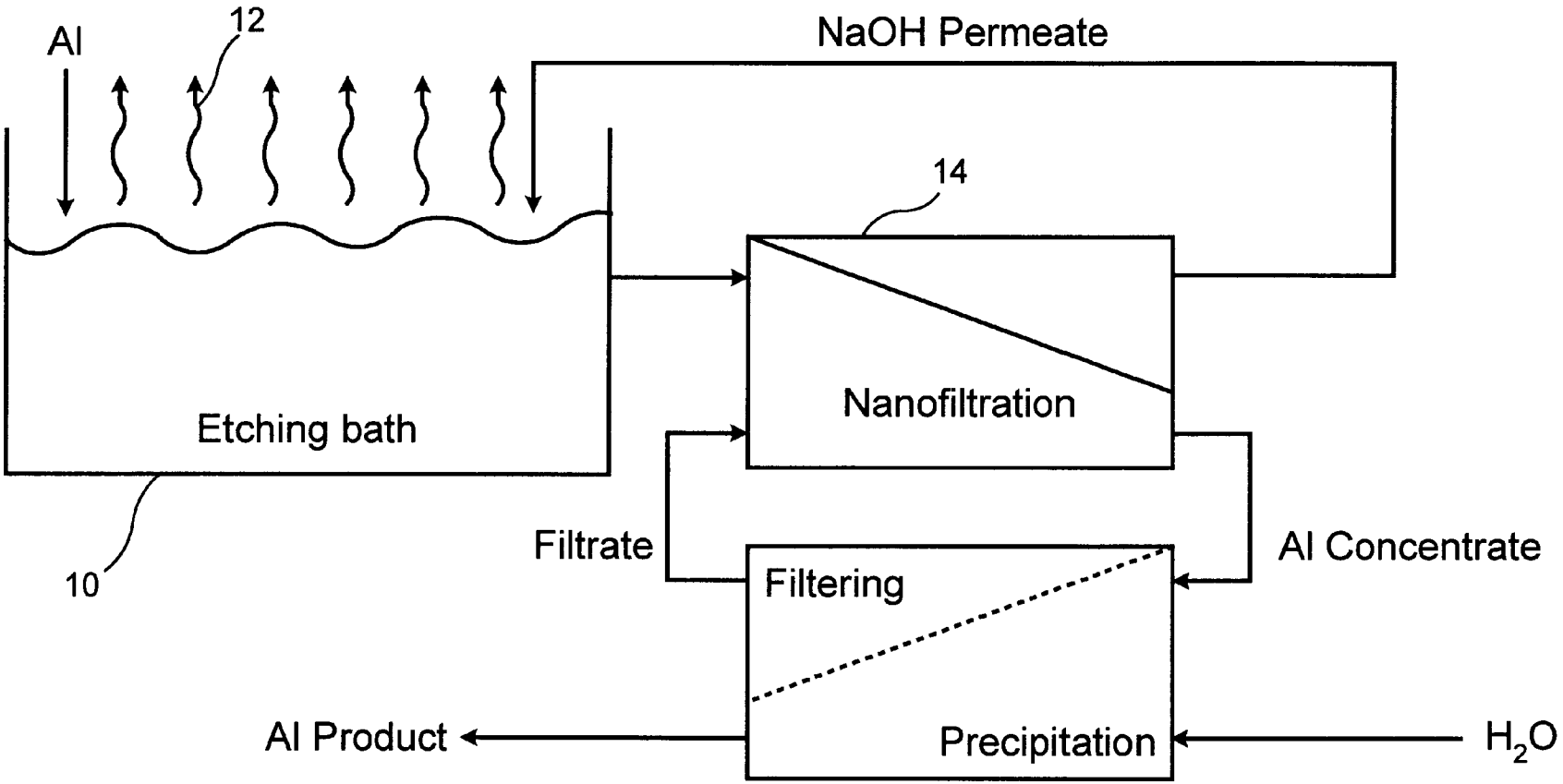

The present invention relates to a method of operating etching baths whereby a metal workpiece to be etched is dipped in an etching bath containing a medium, the metal is oxidized by a chemical reaction between metal and etching medium and converted into a soluble complex, a resulting mixture obtained is separated by removing the excess etching medium from the complex, the recovered etching medium is reused to operate etching baths, and the complex is subjected to a recovery process.

RELATED TECHNOLOGY

European Patent Application A 0 465 822.

The etching bath described therein is an alkaline etching bath in which workpiece made of aluminum are dissolved using a sodium hydroxide solution according to the following equation:

$$2Al+2NaOH+6\ H_2O\ 2NaAl(OH)_{4+3}H_2$$

Thus aluminum is oxidized and converted into a water-soluble aluminate complex $Al(OH)_4$.

In the method described in European Patent Application A 0 465 822 for recovering sodium hydroxide and obtaining aluminum hydroxide, the etching bath mixture having a high concentration of metal ion complex is treated so that a dialysis step is initially performed. In this dialysis step, most of the sodium hydroxide is separated from the aluminate complex. The sodium hydroxide solution obtained in the dialysis step is still sufficiently concentrated so it can be recycled to an etching bath. The aluminate solution is, however, considerably diluted by the dialysis step. The concentration is approximately one-half of the original concentration.

The process of recovery of the complex includes hydrolyzing the aluminate complex into insoluble aluminum hydroxide and a sodium hydroxide solution by adding water, which occurs according to the following equation:

$$H_2O$$

$$NaAl(OH)_4 \longleftrightarrow NaOH+Al(OH)_3$$

The aluminum hydroxide that precipitates represents a valuable material, which is supplied to the aluminum industry, for example; it approximately corresponds to the material obtained in the known Bayer process.

The disadvantage of the above-mentioned method is that large amounts of water are needed for the dialysis step, i.e., for the diffusion dialytic removal of sodium hydroxide, in order to maintain the concentration gradient needed for the operation of the dialysis. Dialysis rates are extremely low, and a very high membrane surface is needed to convert the required amounts.

In order to recover the complex in an industrially feasible manner, very high aluminate concentrations must be initially achieved in the etching bath, since otherwise the solution becomes diluted during the dialysis step to the point that proper recovery is no longer possible.

It has, however, been found that it is unfavorable for the etching results if very high concentrations of metal complex build up in the etching bath, since this considerably reduces the etching speed. If the concentration in the-etching bath comes close to the saturation limit of the metal complex during operation, there is the risk that improper control may cause precipitation in the bath, which is by no means desirable, since the workpieces to be machined are then contaminated and expensive cleaning steps must be subsequently performed.

U.S. patent application Ser. No. 5,141,610 describes a method of performing the separation of the etching medium by electrodialysis in the recovery of acidic or alkaline etching baths. In electrodialysis, an electric field is applied across the membrane, in which the dialysis membrane absorbs a sodium hydroxide solution, for example, on one side and releases it on the other side. Electrolytic processes take place on the electrodes.

This method requires less membrane surface; however, it requires a high amount of power, and the electrodes required for the electrolysis are attacked by the highly corrosive bath medium. This method is not suitable for economically processing large amounts of etching bath liquid in the order of hundreds of cubic meters.

Processing economically on an industrial scale is an aspect of the present invention.

World Patent 01 670 Al describes a method for processing aqueous, metal ion-containing waste solutions. The separation of process products and their removal from the solvent (water) is performed by combining reverse osmosis and a "water splitting" process, such as electrodialysis. The process products are separated from one another by ion-selective electrodialysis and water is separated from the process products using reverse osmosis; the sequence of operations is unimportant. The different process streams are at least partially recycled.

However, reverse osmosis is not ion-selective and therefore can only be used for separating process products in combination with another process such as electrodialysis. Combining two processes involves high process costs. The problems of electrodialysis have been mentioned previously.

Etching is understood in the context of the present invention not as light superficial etching or corroding of a piece of metal, but well-defined and substantial removal of material, such as performed in machining.

In the aerospace industry, large components made of aluminum are used; for example, aircraft fuselages are largely made of aluminum. Due to the manufacturing tolerances in the molding processes, for example, for forming aircraft fuselage linings, the premolded parts must be subjected to chemical etching in order to remove large amounts of material, i.e., aluminum, often only from certain areas. In the aerospace industry, component weight is very important, so that it is customary to chemically etch molded components, which are too heavy due to manufacturing tolerances, to a certain weight.

Accordingly, etching baths are very large. Volumes of 60 $m^3$ are possible for handling such large components. Consequently large amounts of etching baths must be recovered.

SUMMARY OF THE INVENTION

Therefore, an object of the present invention is to operate an etching bath so that favorable and easy-to-control bath conditions are always ensured, yet etching bath recovery requires simple equipment and has a low power consumption.

The present invention provides a method of operating etching baths and a device for carrying out the method in which a mixture of dissolved complexed metal ion and etching medium is removed from the etching bath at a concentration of the dissolved complexed metal ion that is far below its saturation to limit.

A nanofiltration separation is performed in which the etching medium is separated from the mixture using the principle of reverse osmosis, with the concentration of the complexed metal ion in the residue being increased simultaneously.

Thus, according to a the present invention, the mixture of dissolved complexed metal ion and etching medium is removed when the complexed metal ion concentration is still relatively low. As mentioned before, it has been determined that well-defined etching conditions that are easy to control can be achieved at relatively low dissolved metal complex concentrations, which become increasingly unfavorable and difficult to control as the concentration increases. The present invention provides the possibility of an economical subsequent recovery because the concentration of complexed metal ion in the residue increases simultaneously due to the separation by nanofiltration.

In nanofiltration, the medium to be filtered is subjected to pressure and ion-selective membrane separation occurs. The synonyms hyperfiltration and low-pressure reverse osmosis are also used for the term nanofiltration. Small molecules, such as sodium hydroxide or water, for example, can easily pass through the membrane, while larger molecules, such as those of the metal complex, only pass through the membrane with difficulty. Therefore, both water and etching medium, for example, a sodium hydroxide solution, can be separated from the etching bath mixture, whereby the metal complex concentration in the remaining solution increases.

When the etching bath is operated according to the present invention, the etching bath is not left to attain a level of high metal complex concentration that allows economical subsequent recovery, but it is removed from the etching bath at very low concentrations. In the subsequent nanofiltration, the etching medium and water are separated and thus the metal complex is concentrated at the same time so that the complex can be economically recovered.

The object is achieved completely in this way.

In another embodiment of the present invention, in which etching medium is released again as the complex is recovered, the resulting solution is also sent to nanofiltration.

Returning to the example of recovery of a sodium aluminate complex, a sodium hydroxide solution is obtained again. This means that the aqueous filtrate contains sodium hydroxide solution and residual amounts of sodium aluminate complex. By supplying this solution to the solution to be nanofiltered, the sodium hydroxide that was bound in the aluminate complex in the previous nanofiltration can also be separated and recycled to the etching bath. This makes it possible to recycle almost all the necessary sodium hydroxide solution, which results in considerable economical and environmental advantages in industrial systems.

In another embodiment of the present invention, in which the complex is recovered by diluting with water and precipitating and separating the metal as a hydroxide, water addition is controlled so that the filtrate resulting from the separation compensates for the evaporation losses of the etching bath.

Etching baths are often operated at high temperatures, for example in the range of 75–80° C., so that a considerable amount of water gradually evaporates from the etching bath. By adding an appropriately diluted filtrate from the recovery process of the complex, appropriate amounts of water can be supplied to the nanofiltration, which pass through the nanofiltration membrane together with the sodium hydroxide solution and thus ensure sufficient water is refilled into the etching bath.

In another embodiment of the present invention, the mixture of dissolved complexed metal ion and etching medium is removed from the etching bath continuously or batchwise, depending on the size of the system and the control method used.

In another embodiment of the present invention, namely when operating alkaline etching baths for dissolving aluminum, the mixture of hydroxide solution and aluminate complex is removed at aluminum bath concentrations in the range of 5–20 g/l aluminum. This measure offers the advantage that the bath is operated at very low aluminum concentrations. At very low aluminum concentrations in the bath almost pure sodium hydroxide solution is present, which is so concentrated and aggressive that, for example, when very large parts are dipped into it, no uniform etching effect can be achieved, since the areas dipped first are etched for a longer time and therefore more strongly than those dipped later. At very high aluminum concentrations in the etching bath, the etching rate strongly decreases, creating the risk of overconcentration points, so that precipitation may occur.

In another embodiment of the present invention, the hydroxide solution concentration in the etching bath is in the range of 110–150 g/l sodium hydroxide. The sodium hydroxide obtained in nanofiltration is continuously recycled so that the concentration is maintained in this advantageous range, which allows an optimum and well-defined, and thus easily controlled etching result to be achieved.

In another embodiment of the present invention, nanofiltration is performed so that aluminum is concentrated to 100 g/l.

By increasing concentration to this high range, a supersaturated metal complex solution is obtained, which can be economically recovered. Spontaneous crystallization takes place in this solution.

While basically the dissolution of aluminum was described above in order to explain alkaline etching baths, of course obviously other metals that dissolve and form corresponding complexes in alkaline media, such as zinc, can also be etched.

A similar method can also be used in operating acidic etching baths, where the anion is converted to a complex in the acid, for example, chloro-complexes are formed during the dissolution of hydrochloric acid. Such complexes can also be recovered by diluting with water or by making alkali, and the corresponding metal hydroxides can be precipitated.

Of course, the above-named features, to be explained in more detail in the following, can be used not only in the given combinations, but also in other combinations or by themselves without going beyond the scope of the present invention is explained in more detail in the following with reference to a the drawing in which.

Figure 2:
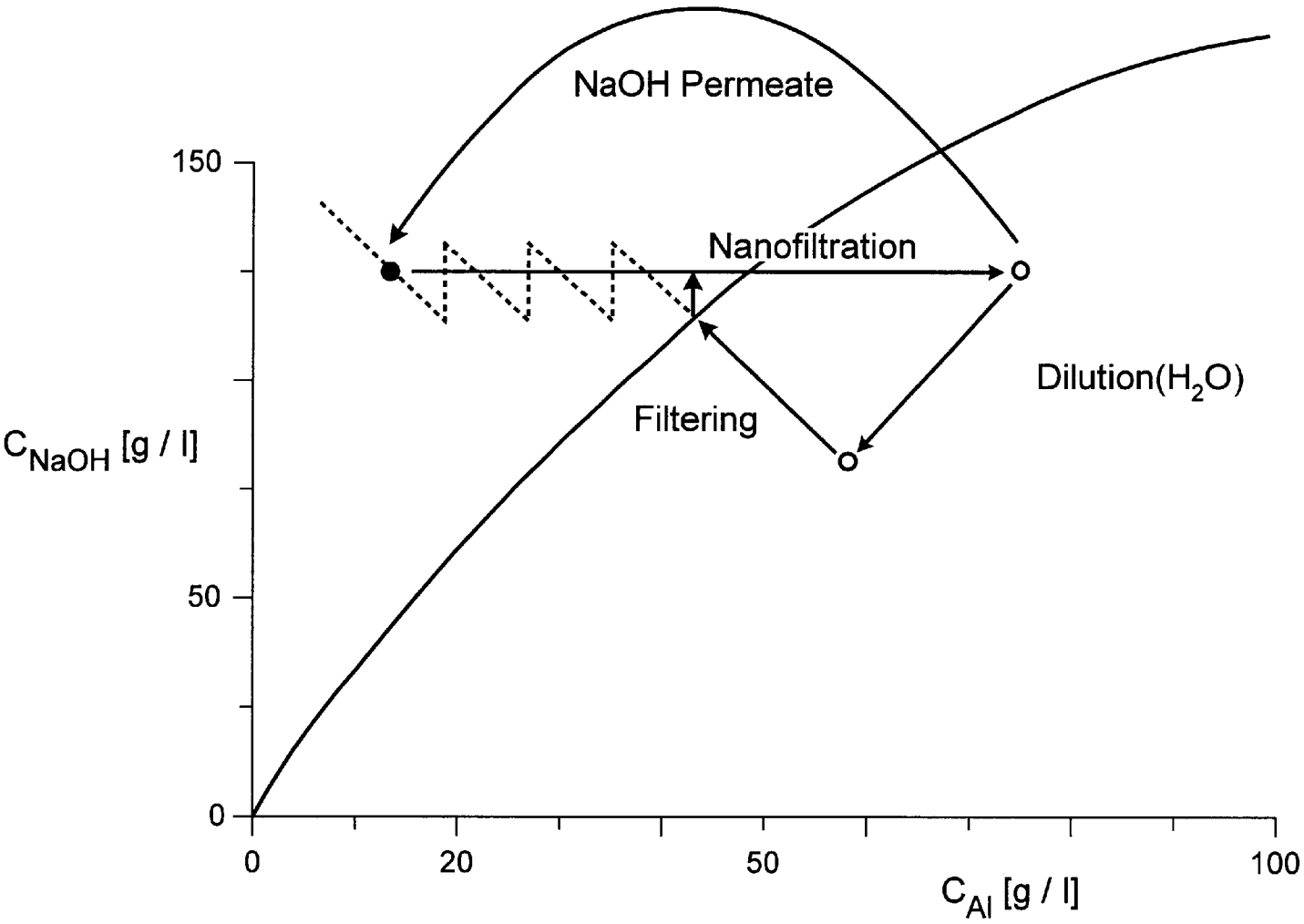

FIG. 1 show a schematic diagram of exemplary system for performing a with the method according to the present invention; and FIG. 2 shows a diagram in which etching medium concentration is plotted against the concentration of the dissolved metal complex to elucidate the process management for the system of FIG. 1, and also indicates an exemplary conventional bath control (dashed sawtooth curve).

DETAILED DESCRIPTION

FIG. 1 shows an etching bath 10, which contains an aqueous solution of sodium hydroxide as the etching medium. The etching bath has an approximate volume of 60 $m^3$ and is operated at a temperature of 75–80° C., so that considerable amounts of water vapor 12 are released.

Metal workpieces made of aluminum, for example, large-surface bent aircraft lining components, having dimensions of several meters, are dipped into etching bath 10.

The aluminum contained in the pieces reacts with the sodium hydroxide solution, forming hydrogen and a soluble sodium aluminate complex $NaAl(OH)_4$.

When the system has reached a steady state and a bath concentration of approximately 10 g aluminum per liter bath liquid, the latter is removed and sent to a nanofilter 14, in which nanofiltration is performed.

Nanofilter 14 is designed so that an internal pipe has a tubular support structure, where a membrane is placed. This pipe is surrounded by another pipe.

Such nanofilters are used as module units such as marketed by Membrane Products Kiryat Weizmann Ltd., Rehovot/Israel under the name SelRO Tubula Modul™ 1228. The membrane used follows the MPT-34 specification.

The membrane pipe of a pipe module has a diameter of approximately 10 mm; the support has a perforated, porous, tubular support body on which the MPT-34 membrane is mounted.

Such a module is operated by the cross-flow principle, i.e., a pressure of 1–6 mPa is applied to the etching bath solution by a pump (not illustrated), and the solution is conveyed in one direction through the inner pipe with a velocity of 1–2 m/s. Under these conditions, sodium hydroxide and water molecules pass through the membrane in the radial direction and are converted into NaOH permeate, which is recycled to etching bath 10. The aluminate in the etching bath solution, which is now poorer in water and sodium hydroxide, is concentrated after leaving nanofilter 14. The conditions are selected so that aluminum concentration is increased to the range of approximately 50–100 g/l aluminum.

This liquid, referred to as Al concentrate, can now be sent to a recovery process, which can be performed either on site or at an aluminum manufacturing company.

The Al concentrate is diluted with water according to the known Bayer process and optionally the aluminum hydroxide $Al(OH)_3$ obtained is precipitated by the addition of appropriate seeding crystals, centrifuged and supplied as an aluminum product to aluminum manufacturing, for example.

The filtrate remaining after the separation by filtration and centrifugation of $Al(OH)_3$ that has precipitated contains the sodium hydroxide solution obtained by hydrolysis of the sodium aluminate complex and may also contain dissolved, unhydrolyzed sodium aluminate complex. This filtrate can be supplied again to nanofilter 14, where it is converted into NaOH permeate and recycled to etching bath 10.

Thus, in industrial plants, sodium hydroxide (NaOH) can be recirculated on site in a closed circuit. Considering that an aircraft manufacturer uses about 1200 tonnes sodium hydroxide a year in etching baths, the economic dimension of recovery and recycling of sodium hydroxide becomes clear.

Using the diagram of FIG. 2, the advantageous process management becomes even clearer. Etching bath 10 of FIG. 1 is operated so that the sodium hydroxide solution concentration is about 120 g/l, and the concentration of dissolved aluminum is, for example, in the range of 10 g/l. Using nanofiltration and continuous recycling of the NaOH permeate obtained these bath conditions can be maintained over a long period. Under these conditions, optimum etching results can be obtained, i.e., the etching rate is not so high that large parts are non-uniformly etched when dipped in the solution, but it is sufficiently high as desired.

During nanofiltration, aluminum concentration is increased, which is indicated by the horizontal arrow to the right. In the embodiment illustrated, an aluminum concentration of approximately 75 g/l is obtained. Under these conditions about 70–80% of the sodium hydroxide solution contained in the etching bath has already been removed and converted into NaOH permeate.

A dilution step with water is initially performed, so that this solution becomes correspondingly relatively poor in sodium and aluminum (in the form of dissolved aluminate complex).

Subsequently, the aluminum hydroxide is precipitated by adding seed crystals, and the precipitated aluminum hydroxide is separated by filtration or centrifugation, for example. The filtrate obtained contains, in addition to residual amounts of the unhydrolyzed sodium aluminate complex, sodium hydroxide solution, obtained in the hydrolysis of the complex, i.e., sodium hydroxide that was previously bound becomes free again.

This filtrate is supplied again to nanofiltration, the process being controlled so that the sodium hydroxide permeate is diluted to the extent that the evaporation losses of the etching bath are compensated for.

The dilution step described above is performed initially because direct hydrolysis of the highly concentrated aluminate solution would result in a sodium hydroxide concentration in the filtrate that is much higher than the desirable concentration of the bath solution. By recycling the filtrate after precipitating the aluminum hydroxide, the remaining 20–30% of the sodium hydroxide solution contained in the etching bath can be recovered and recycled, so that ultimately no sodium hydroxide solution is consumed.

It can be seen that this method is very easy to control, only the aluminum concentration needs to be measured and then the mixture is removed from the etching bath continuously or batchwise.

FIG. 2 shows conventional bath control with the dashed sawtooth curve. Starting at the upper left end of the sawtooth curve, it can be seen that the initial bath concentration in the solution is approximately 150 g/l sodium hydroxide. The sodium hydroxide solution concentration decreases and the concentration of dissolved aluminum increases to, for example, a value in the range of 20 g/l aluminum due to the reaction with the aluminum workpiece. This concentration increases suddenly again due to the addition of sodium hydroxide to the etching bath from the outside, and the etching process continues with more sodium hydroxide solution being consumed again and the concentration of aluminum continuously increasing in the etching bath. When a concentration of 30 g aluminum per liter etching bath is attained, sodium hydroxide solution is added again; such a bath is already considered a poor bath. Operation may continue until the saturation curve is reached, with aluminum concentration attaining at most barely 50 g/l under these conditions. At this point there is already a risk that precipitation may occur, since the process is taking place very near the saturation range. It can be seen that the control via the sawtooth curve requires considerable instrumentation, which is much more expensive than measurements in the process according to the present invention.

With the bath control as described, etching rates can be doubled from approximately 1 mm/h to about 2 mm/h of material thickness by working under optimum etching conditions.

Furthermore, it has been found that downtime due to bath renewal is decreased considerably; in the sawtooth operation, downtime amounts to approximately 30% for replacing the complete bath and replacing it with a fresh one, removing the bottom product of precipitated $Al(OH)_3$ and cyclically adding sodium hydroxide solution.

Due to the precise operation at ideal conditions, it is very easy to arrive at a point that is very close to the optimum etching depth, while previously only 90% of the optimum etching depth was achieved, and iterative measurements were needed.

What is claimed is:

1. A method for operating an etching bath comprising:

dipping a metal workpiece in the etching bath, the etching bath containing an etching medium, the metal being oxidized by a chemical reaction between the mete and the etching medium and converted into a complexed metal ion dissolved with the etching medium;

removing a mixture of the dissolved complexed metal ion and the etching medium from the etching bath at a concentration of the dissolved complexed metal that is below a saturation limit of the dissolved complexed metal ion;

separating the etching medium from the mixture via a nanofiltration using a principle of reverse osmosis so as to provide recovered etching medium and a residue while concentrating the complexed metal ion in the residue;

reusing the recovered etching medium in the etching bath; and performing a recovery process on the dissolved complexed metal ion.

2. The method as recited in claim 1 wherein the recovery process releases etching medium as the complex is recovered.

3. The method as recited in claim 2 wherein the recovery process includes diluting the residue with water and precipitating and separating the metal of the complex so as to provide a hydroxide of the metal and a filtrate, a water addition of the dilution being controlled so that the filtrate compensates for an evaporation loss of the etching bath.

4. The method as recited in claim 1 wherein the removing is performed continuously.

5. The method as recited in claim 1 wherein the removing is performed in a batch fashion.

6. The method according to claim 1 wherein the etching bath is an alkaline etching bath for dissolving aluminum and the mixture includes a hydroxide solution and aluminate complex, the removing being performed when a concentration of the aluminum in the mixture is in a range of 5 to 20 g/l.

7. The method as recited in claim 6 further comprising maintaining a concentration of the hydroxide solution in a range of 110 to 150 g/l.

8. The method as recited in claim 1 wherein the metal is aluminum and the nanofiltration is performed so that complexed metal ion is concentrated so as to provide a concentration of the aluminum of up to 100 g/l.

9. The method as recited in claim 1 wherein the nanofiltration is performed under a pressure of between 1 to 6 MPa.

* * * * *

UNITED STATES PATENT AND TRADEMARK OFFICE

CERTIFICATE OF CORRECTION

PATENT NO. : 6,454,958 B1
DATED : September 24, 2002
INVENTOR(S) : Karsten Loehr It is certified that error appears in the above-identified patent and that said Letters Patent is hereby corrected as shown below:

Column 1,
Line 10, delete “a resulting” and insert -- the -- therefor;
Line 17, before “European” insert -- A method of operating etching baths is described in --;
Line 17, after “Application” insert -- No. --;
Line 23, delete the equation and insert therefor -- $2Al + 2NaOH + 6H_2O \rightarrow 2NaAl(OH)_4 + 3H_2$ --;
Line 27, after “Application” insert -- No. --;

Column 2,
Line 6, change “U.S. patent application Ser.” to -- U.S. Patent Application --;
Line 22, after “Patent” delete “01 670 A1” and insert -- Application No. 85/01670 A1 -- therefor;
Line 59, before “ensured” deleted “always”;
Line 67, after “saturation” delete “to”;

Column 3,
Line 6, after “to” delete “a” --;
Line 37, “The object is achieved completely in this way.”;

Column 4,
Line 39, delete “obviously”;
Line 52, after “invention” insert -- . --;
Line 52, after “invention.”, insert a new paragraph with the heading -- BRIEF DESCRIPTION OF THE DRAWINGS -- and insert before “is explained” -- The present invention --;

UNITED STATES PATENT AND TRADEMARK OFFICE

CERTIFICATE OF CORRECTION

PATENT NO. : 6,454,958 B1
DATED : September 24, 2002
INVENTOR(S) : Karsten Loehr It is certified that error appears in the above-identified patent and that said Letters Patent is hereby corrected as shown below:

Column 4 cont'd.,
Line 53, change "a the drawing in which." to -- the drawings, in which: --
Line 54, after "FIG. 1" change "show" to -- shows --;
Line 54, before "exemplary" insert -- an --;
Line 55, before "method" delete "with the"; and Column 7,
Line 20, change "mete" to -- metal --.

Signed and Sealed this

Seventh Day of September, 2004

JON W. DUDAS
*Director of the United States Patent and Trademark Office*